US005674020A

United States Patent [19]

Kimura et al.

[11] Patent Number: 5,674,020

[45] Date of Patent: Oct. 7, 1997

[54] COATING FLUID HOLDING MEMBER AND OIL COATING ROLLER USING THE SAME

[75] Inventors: Kohichi Kimura; Osamu Horiuchi; Nobuya Tomosue; Tatsuo Takagi, all of Kanagawa, Japan

[73] Assignee: Nichias Corporation, Tokyo, Japan

[21] Appl. No.: 530,737

[22] Filed: Sep. 19, 1995

[30] Foreign Application Priority Data

Sep. 19, 1994 [JP] Japan ..... 6-248313

[51] Int. Cl.[6] ..... B05C 1/00; B25F 5/02; B41F 13/10

[52] U.S. Cl. ..... 401/197; 101/376; 355/248; 492/50

[58] Field of Search ..... 401/196, 197; 101/375, 376, 348; 355/248; 118/264; 492/50, 55, 56, 59

[56] References Cited

U.S. PATENT DOCUMENTS

| | | | |
|---|---|---|---|
| 3,812,782 | 5/1974 | Funahashi | 492/59 X |
| 3,852,862 | 12/1974 | Sukenik | 492/50 |
| 4,757,347 | 7/1988 | Tamaoki et al. | 355/284 |
| 4,887,340 | 12/1989 | Kato et al. | 492/56 X |
| 5,468,531 | 11/1995 | Kikukawa et al. | 492/56 X |

FOREIGN PATENT DOCUMENTS

| | | | |
|---|---|---|---|
| 1071291 | 2/1980 | Canada | 355/284 |
| 60-136782 | 7/1985 | Japan . | |
| 60-247276 | 12/1985 | Japan . | |
| 63-37369 | 2/1988 | Japan . | |
| 1-32985 | 7/1989 | Japan . | |

*Primary Examiner*—Robert A. Hafer
*Assistant Examiner*—D. Neal Mair
*Attorney, Agent, or Firm*—Cushman Darby & Cushman; Intellectual Property Group of Pillsbury Madison & Sutro, LLP

[57] ABSTRACT

Disclosed is an oil coating roller composed of a coating fluid holding member comprising a porous hollow cylindrical molded body impregnated with a coating fluid, such as silicone oil, with a driving shaft inserted through the hollow portion thereof, both ends of the coating fluid holding member being fixed to the driving shaft, and felt fabricated of heat-resistant fiber wounded around the outer surface thereof, wherein the porous hollow cylindrical molded body is fabricated of heat-resistant fibers bound to each other with a binder and has an average pore size of 15 to 50 μm and a porosity of 50 to 80%. The oil coating roller can be produced with ease, stably feeds the coating fluid for an extended period of time, and is particularly suitable for applying silicone oil to a fixing roller of an electrostatic copying machine.

3 Claims, 1 Drawing Sheet

FIGURE
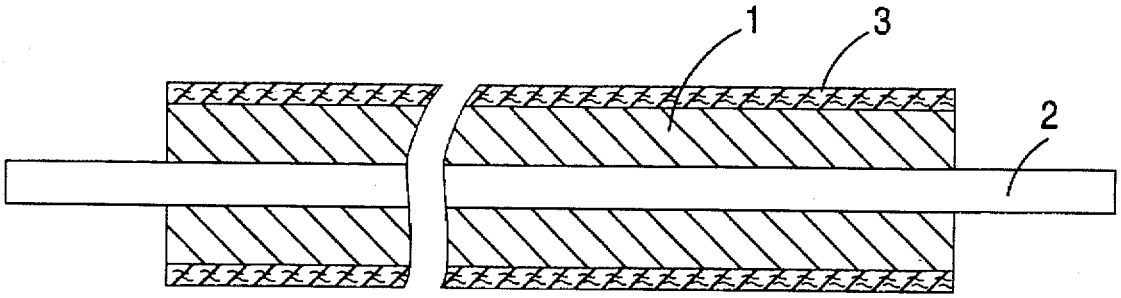

COATING FLUID HOLDING MEMBER AND OIL COATING ROLLER USING THE SAME

FIELD OF THE INVENTION

This invention relates to a coating fluid holding member which is used in a coating applicator for uniformly applying a coating fluid, such as a parting agent, an oil, a coating compound, etc., and an oil coating roller of a fixing device used in an electrostatic copying machine, an electrophotographic printer, and the like.

BACKGROUND OF THE INVENTION

Various applicators for applying a coating fluid for modifying surface properties of an article, such as a parting agent, an oil or a coating compound, to the surface of the article have been proposed. For example, most of fixing devices employed in electrostatic copying machines and electrophotographic printers are equipped with a part called an oil coating roller. While rotating in contact with a fixing roller, the oil coating roller feeds a very small amount of silicone oil to the surface of the fixing roller so as to improve the release of recording paper from the fixing roller. The oil coating roller also serves to wipe up the toner adhering to the fixing roller so as to prevent offset.

While, in some cases, silicone oil to be applied to a fixing roller is supplied successively from a separately provided oil reservoir to the oil coating roller, it is an ordinary case where a given amount of silicone oil is held in an oil coating roller itself, and the whole coating roller is exchanged when the oil held therein has been used up.

The conventional mechanism for holding silicone oil in an oil coating roller includes (1) paper or felt wound around a driving shaft either directly or via a silicone rubber layer and impregnated with silicone oil, (2) an oil holding layer (e.g., felt) wound around a driving shaft and impregnated with silicone oil and having further provided thereon a felt layer to be brought into contact with a fixing roller, and (3) an oil-permeable and hollow driving shaft of an oil coating roller, the hollow portion of which is filled with silicone oil.

An oil coating roller is required to cause little variation of the oil feed rate during use, to cause no stains of recording paper due to excessive oil coating upon resumption of operation after long-term suspension, to have large oil holding capacity with its size minimized, and to have durability in long-term use.

SUMMARY OF THE INVENTION

Consideration being given to the above-mentioned various performance properties demanded for an oil coating roller, an object of the present invention is to provide a novel oil coating roller which feeds oil stably for a long period of time and can easily be produced.

Another object of the present invention is to provide a coating fluid holding member which is suited for use as an oil holding member of an oil coating roller.

The present invention provides a coating fluid holding member comprising a porous molded body fabricated of heat-resistant fibers bound to each other with a binder and having an average pore size of 15 to 50 μm and a porosity of 50 to 80% and an oil coating roller using the coating liquid holding member as a silicone oil reservoir.

DETAILED DESCRIPTION OF THE PREFERRED EMBODIMENTS

FIG. 1 is a cut-away view of an oil coating roller.

DETAILED DESCRIPTION OF THE INVENTION

Referring to the sole FIGURE, the oil coating roller of the present invention is constituted by impregnating the coating liquid holding member 1 with silicone oil until the fine pores thereof are filled with silicone oil, inserting a driving shaft 2 through the hollow portion of the coating liquid holding member 1, fixing the holding member 1 to the driving shaft 2 at both ends thereof, and adhering felt 3 fabricated of heat-resistant fibers onto the surface of the holding member 1 in the same manner as for the surface layer of a conventional oil coating roller.

The silicone oil held in the pores of the coating liquid holding member 1 slowly oozes out to wet the surface of the fibers constituting the surface felt layer 3. While the equipment to which the oil coating roller is fitted is in operation, the silicone oil is thus applied to, a fixing roller with which the oil coating roller rotates in contact. On transfer of silicone oil of the surface felt layer 3 to the fixing roller, an amount of silicone oil transferred is successively supplied from the oil holding member so that the surface felt layer 3 is always kept wet with silicone oil.

The coating liquid holding member 1 should have an average pore size of 15 to 50 μm so that the surface felt layer 3 may be replenished with silicone oil smoothly. If the pore size is smaller than 15 μm, the oil holding power of the holding member due to a capillary phenomenon is too strong to replenish the surface felt layer 3 with silicone oil smoothly, and the fixing roller tends to be starved of silicone oil when, for example, the equipment using the oil coating roller is in continuous operation. If the pore size exceeds 50 μm, the oil holding power is so low that excessive silicone oil migrates to the surface felt layer 3, resulting in excessive oil feed to the fixing roll. In particular, while the equipment is out of operation, a large amount of the oil migrates to the part of the fixing roller in contact with the oil coating roller, which causes staining of recording paper on resumption of operation. Measurement of the average pore size can be conducted using a mercury porosimeter.

The porosity of the coating liquid holding member 1 relates to the silicone oil holding capacity rather than the above-described oil oozing properties. The higher the porosity, the higher the holding capacity. If the porosity is less than 50%, the holding member 1 retains only a little silicone oil, and the oil coating roller has too short a life. If the holding member 1 is highly porous as having a porosity exceeding 80%, strength necessary as an oil coating roller is hardly secured.

The terminology "porosity" as used herein means a value calculated according to equation:

$$\text{Porosity (\%)}=(1-\text{bulk specific gravity/true specific gravity})\times 100$$

The method for producing the coating liquid holding member 1 of the present invention will be described below.

The heat-resistant fiber which can be used as a raw material may have an arbitrary composition and includes rock wool, aluminosilicate fiber, alumina fiber, glass fiber, aramid fiber. In order to obtain a coating liquid holding member 1 having the aforesaid large pore size, it is advantageous to use slightly thick fibers, for example, those having a fiber diameter of about 2 to 15 μm.

The binder to be used includes organic binders such as methyl cellulose (preferably having a molecular weight of $10^4$ to $10^7$), carboxymethyl cellulose, hydroxymethyl cellulose, hydroxyethyl cellulose, polyvinyl alcohol, phenol resins, polyacrylic esters, and sodium polyacrylate; and inorganic binders, such as colloidal silica and alumina sol.

The coating fluid holding member 1 of the present invention may further comprise clay or ceramic powder having a particle size of 100 μm or less such as alumina, silica and mullite, with the total amount thereof being 0 to 50% by weight based on the amount of the heat-resistant fiber.

The heat-resistant fiber and binder are mixed together with an appropriate amount of water to prepare a uniform plastic mixture. The fiber diameter of the heat-resistant fiber used influences the pore size of the product, and the porosity depends on the amounts of the binder and water used. While varying depending on the product characteristics required, the heat-resistant fiber and binder are preferably mixed such that the weight ratio of the heat-resistant fiber and the binder is from 50:50 to 90:10, and water is preferably added in an amount of 100 to 200 parts by weight per 100 parts by weight of the sum of the heat-resistant fiber and the binder.

The coating liquid holding member 1 of the present invention can be obtained by molding the resulting plastic mixture and drying at ordinary temperature or by heating. For production of a coating liquid holding member 1 for use in an oil coating roller, the plastic mixture is extrusion molded into a hollow cylinder of prescribed size and cut to an appropriate length in agreement with the length of an oil coating roller before or after drying.

An oil coating roller can be produced by impregnating the resulting coating liquid holding member 1 having an inner diameter slightly larger than the diameter of the driving shaft of an oil coating roller with silicone oil, inserting the driving shaft 2 through the hollow portion of the holding member 1, fixing the holding member 1 to the driving shaft 2 at both ends thereof, and winding felt 3 fabricated of arbitrary heat-resistant fiber, such as aramid fiber, around the surface of the holding member 1.

The amount of silicone oil that can be held in the thus prepared coating liquid holding member 1 is usually about 45 to 180% by weight based on the weight of the holding member 1, though varying depending on the porosity of the holding member 1.

The present invention will now be illustrated in greater detail with reference to Example, but it should be understood that the present invention is not deemed to be limited thereto.

EXAMPLE

A plastic mixture was prepared by kneading 67 parts by weight of aluminosilicate fiber having an average fiber diameter of 3.8 μm, 15 parts by weight of methyl cellulose as an organic binder, and 95 parts by weight of water. The plastic mixture was extrusion molded into a hollow cylinder and dried at 105° C. to obtain a coating liquid holding member 1 having a porosity of 72.9%, an average pore size of 18.8 μm, an inner diameter of 6 mm, a bulk specific gravity of 0.64, an outer diameter of 16 mm, and a length of 300 mm.

The resulting coating liquid holding member 1 was soaked in silicone oil having a viscosity of 60000 cSt to pick up 35 g of silicone oil. A driving shaft 2 of 6 mm in diameter was inserted into the hollow portion of the oil-impregnated holding member 1, and each end of the holding member was fixed to the driving shaft 2 with a ring fitment. Felt 3 fabricated of heat-resistant aramid fiber was wound around the outer surface of the holding member 1 to complete an oil coating roller.

The oil coating roller was set on an oil oozing property testing machine, and change of the amount of oil fed was examined under the same paper feed condition as in a copying machine. As a result, the amount of oil fed per 1000 sheets of recording paper was from 0.07 to 0.1 g, which is a satisfactory coating weight, until the number of sheets fed reached 100,000.

Comparative Example

For comparison, a coating liquid holding member 1 having an average pore size of 14.2 μm, a porosity of 75.9%, and a bulk specific gravity of 0.55 was prepared in the same manner as described above, except for using aluminosilicate fiber having an average fiber diameter of 1.5 μm as a raw material. An oil coating roller was produced using the resulting coating liquid holding member 1 and tested in the same manner as described above. In this case, although the oil pick-up was 36 g which was not so different from that of the holding member 1 of Example, it was only up to 20,000 sheets of recording paper that the satisfactory oil coating weight as above stated was maintained.

As described above, the present invention provides a coating liquid holding member 1 and an oil coating roller which retain a coating liquid, such as silicone oil, at a high volume ratio and stably releases the liquid for an extended period of time and which can be produced with ease, thereby making size reduction and life extension of an oil coating roller feasible.

While the coating liquid holding member 1 is particularly suitable for use in an oil coating roller for a fixing device of an electrostatic copying machine, etc., the use of the holding member 1 is not limited thereto, and the coating liquid holding member 1 can be applied to applicators of various parting agents, oils, and coating compounds.

While the invention has been described in detail and with reference to specific examples thereof, it will be apparent to one skilled in the art that various changes and modifications can be made therein without departing from the spirit and scope thereof.

What is claimed is:

1. A coating fluid holding member comprising a porous molded body fabricated of heat-resistant fibers bound to each other with a binder and having an average pore size of 15 to 50 μm and a porosity of 50 to 80%.

2. The coating fluid holding member of claim 1, wherein said porous molded body is a porous hollow cylindrical molded body.

3. An oil coating roller composed of a coating fluid holding member comprising a porous hollow cylindrical molded body impregnated with silicone oil, with a driving shaft inserted through the hollow portion thereof, both ends of said coating fluid holding member being fixed to said driving shaft, and felt fabricated of heat-resistant fiber wounded around the outer surface thereof, wherein said porous hollow cylindrical molded body is fabricated of heat-resistant fibers bound to each other with a binder and has an average pore size of 15 to 50 μm and a porosity of 50 to 80%.

* * * * *